United States Patent [19]

Yanagiya et al.

[11] Patent Number: 4,634,573

[45] Date of Patent: Jan. 6, 1987

[54] STEEL FOR COLD FORGING AND METHOD OF MAKING

[75] Inventors: Toshio Yanagiya; Kenji Isokawa; Hisashi Ohta; Hideaki Inaba, all of Aichi, Japan

[73] Assignee: Daido Tokushuko Kabushiki Kaisha, Nagoya, Japan

[21] Appl. No.: 662,543

[22] Filed: Oct. 19, 1984

Related U.S. Application Data

[63] Continuation-in-part of Ser. No. 416,492, Sep. 10, 1982, abandoned.

[30] Foreign Application Priority Data

Sep. 10, 1981 [JP] Japan ..... 56-141650

[51] Int. Cl.[4] ..... C21D 7/14

[52] U.S. Cl. ..... 420/127; 148/12.1; 148/319

[58] Field of Search ..... 148/2, 12 F, 36, 12 B, 148/12.1; 75/123 B, 126 J, 126 C

[56] References Cited

U.S. PATENT DOCUMENTS

| | | | |
|---|---|---|---|
| 3,897,279 | 7/1975 | Shaughnessy et al. | 148/12 F |
| 3,997,372 | 12/1976 | Matas et al. | 148/36 |
| 4,137,104 | 1/1979 | Nashiwa et al. | 148/12 F |
| 4,332,630 | 6/1982 | Economopolous et al. | 148/12 B |
| 4,375,378 | 3/1983 | Ohtani et al. | 148/12 B |

FOREIGN PATENT DOCUMENTS

| | | | |
|---|---|---|---|
| 56121 | 5/1978 | Japan | 148/12 B |
| 6456 | 1/1980 | Japan | 75/126 J |
| 28321 | 2/1980 | Japan | 148/12 F |
| 9326 | 1/1981 | Japan | 148/12 F |
| 33425 | 4/1981 | Japan | 148/12 F |
| 800226 | 1/1981 | U.S.S.R. | 75/126 C |

*Primary Examiner*—Wayland Stallard

*Attorney, Agent, or Firm*—Armstrong, Nikaido, Marmelstein & Kubovcik

[57] ABSTRACT

An improved steel for cold forging for machine structural use, particularly, case hardening steel, contents of Al, N and Nb are selected to satisfy a specific corelation therebetween, and the amounts of O and S are controlled. The steel is resistant to cracking at the cold forging, and growth of austenite crystals to coarse grains during carburizing or carbonitriding is prevented.

Disclosed are preferable structure of the steel and rolling conditions to obtain the structure, and conditions for continuous casting of the steel.

10 Claims, 6 Drawing Figures

STEEL FOR COLD FORGING AND METHOD OF MAKING

This is a continuation-in-part of the original application Ser. No. 416,492, filed Sept. 10, 1982, now abandoned.

BACKGROUND OF INVENTION

1. Field of the Invention

The present invention concerns a steel suitable for cold processing such as cold forging, particularly, case hardening steel, and method of making the same. The invention also concerns method of making the case hardening steel, especially, for structural use, by continuous casting process.

2. State of the Art

Generally speaking, cold processing of steel is advantageous over hot processing, beause cold processing enjoys not only improved utilization of material due to smaller amount of scrap occurence but also possible reduction of manufacturing cost by automatization and speeding up of the steps. Cold processing further brings about merits of improved accuracy in dimensions of the products and better working surroundings, and therefore, it is being adopted more and more popular in various fields.

In production of machine structural parts such as gears using a machine structural steel as the material, it is usual to prepare the gear by cold processing such as forming by rolling and pressing, and then to strengthen the surface abrasion resistance and the fatigue strength by surface hardening treatment such as carburizing and carbonitriding. At the step of this surface hardening treatment, the blank of gear made by the cold processing is heated to a temperature of austenite domain above $A_3$ transition point, and held in an atmosphere for surface hardening treatment of the carburizing or the carbonitriding. It has been sometimes experienced that a small member of austenite crystals abnormally grow to form coarse austenite particles of rice-grain size in the steel. Because the coarse particles remain in the steel after hardening and they are more readily hardened in comparison with the surrounding parts, they may cause significant heat treatment strain and decreased resilience.

This problem is particularly significant in case hardening steel for machine structural use. It is experienced even that, further to the decreased resilience due to the coarse particles, crack may occur during the cold processing.

Thus, there has been a demand for the steel for cold forging, which is free from cracking at the cold forging and coarsening of austenite crystals causing decrease of resilience and heat treatment strain during the heat treatment of carburizing or carbonitriding.

In order to prevent the cracking at the cold forging, there has been made efforts to control O-content and S-content so as to minimize oxide inclusion and sulfide inclusion which will provide starting points of the crack at the cold forging. However, it is quite difficult in commercial production of steel to decrease O-content and S-content to such extent that the crack would not occur. Also, decreased amount of S results in lower machinability. As to the coarsening of austenite crystals, no effective solution has been found yet.

In the production of case hardening steel, continuous casting is employed for the purpose of saving energy and stabilizing quality of the products. Recent use of the case hardening steel often requires treatment at such a high temperature as above 1000° C., e.g., vacuum carburizing. Such a high temperature causes coarsening of the austenite crystals of the case hardening steel, and therefore, prevention has been desired.

For the purpose of preventing the coarsening of the austenite crystals at a high temperature, it has been practiced to add Nb and N to the steel so as to precipitate fine Nb(C,N) compounds and to suppress growth of the crystals. Addition amounts of these elements ranges, usually, Nb: 0.03 to 0.06%, and N: 0.008 to 0.014%. However, it is experienced that, in case of continuous casting of the steel containing these elements, the expected effect of suppressing coarsening of the austenite crystals cannot be obtained at the center of the cast piece. Investigation of the cause revealed the phenomenon that Nb(C,N) compounds precipitate in the form of large crystals at the center of the cast piece, where cooling rate is relatively low, and surrounding Nb, C and N concentrate at the center to grow the crystals larger, thus preventing fine Nb(C,N) compounds. The large Nb(C,N) compounds remain in the rolled products as stringer-formed inclusions, which are quite undesirable to some use of the case hardening steel.

SUMMARY OF THE INVENTION

An object of the present invention is to provide a steel for cold forging for machine structural use, particularly, a case hardening steel which is free from the abnormal growth of the austenite crystals during the surface hardening treatment after the cold processing, and the cracking at the cold processing.

We have found that the above mentioned abnormal growth of the coarse crystals during surface hardening treatment can be prevented by controlling the contents of Al, Nb and N in the steel, and that, decrease of resilience caused by increased N-content for prevention of the crystal coarsening may be compensated by adding Al in a certain amount corelated to the contents of N and Nb. Also we ascertained that cracking at the cold processing largely depends on S and O in the steel, and determined upper limits of S- and O-contents which enable improvement of cold processability.

Another object of this invention is to provide a steel for cold forging for machine structural use, particularly, a case hardening steel which may contain S and O in such amounts that are not extremely low but can be readily achieved by usual steel making technology, and, nevertheless, which is free from the cracking at the cold forging.

Our study revealed that better cold processability can be obtained in a steel which has a structure of ferrite+-pearlite, in which ferrite crystal grains are fine. Also our study discovered a suitable alloy composition and a suitable temperature condition for rolling.

A further object of this invention is, therefore, to provide a method of producing the above mentioned steel for cold forging having the ferrite+pearlite structure.

A specific object of this invention is to provide a method of making by continuous casting a case hardening steel in which the austenite crystals may not coarsen during treatment at a high temperature.

As the way to achieve this, we chose to prevent precipitation of large particles of Nb(C,N) compounds at the center of the cast piece by determining permissible limit in the rate of cooling molten steel, and suitable combination of Nb- and N-contents. A certain corelation between them were established.

DRAWINGS

PREFERRED EMBODIMENTS OF THE INVENTION

The case hardening steel of the present invention encompasses various steel for machine structural use, e.g., carbon steel, nickel-chromium steel, nickel-chromium-molybdenum steel, chromium steel, chromium-molybdenum steel, mnganese steel, manganese-chromium steel, which comprises Al: 0.02 to 0.06%, N: 0.015 to 0.03%, Nb: 0.01 to 0.08%, and the balance being Fe, in which $$Al(\%) \geqq 2.0[N(\%) - 0.15Nb(\%)]$$

and further, $O \leqq 15$ ppm and $S \leqq 0.015\%$.

The followings explain the ranges of Al, N and Nb and the specific relations therebetween in the above structural carbon steel and structural alloy steel:

If the Al-content is less than 0.02%, the coarse crystals will occur even if N and Nb are contained in the above noted ranges, and therefore, Al should be contained in the amount of 0.2% or more. More than 0.06% of Al impairs cleanliness to decrease the resilience, and therefore, not preferable.

In case where N-content is less than 0.015%, the crystals will grow to be coarse even at the determined Nb-content and N-content, and thus, at least 0.015% is necessary. N of more than 0.03% may give blow-holes in the product steel.

Also, Nb of less than 0.01% will result in occurrence of the coarse crystals even in case of a high N-content, and 0.01% by Nb is essential. The effect will saturate at about 0.08%, and further content is unnecessary.

Preferable results will be obtained if the following condition is satisfied: between N and Nb $$N(\%) \geqq -0.2Nb(\%) + 0.020.$$

Figure 1:
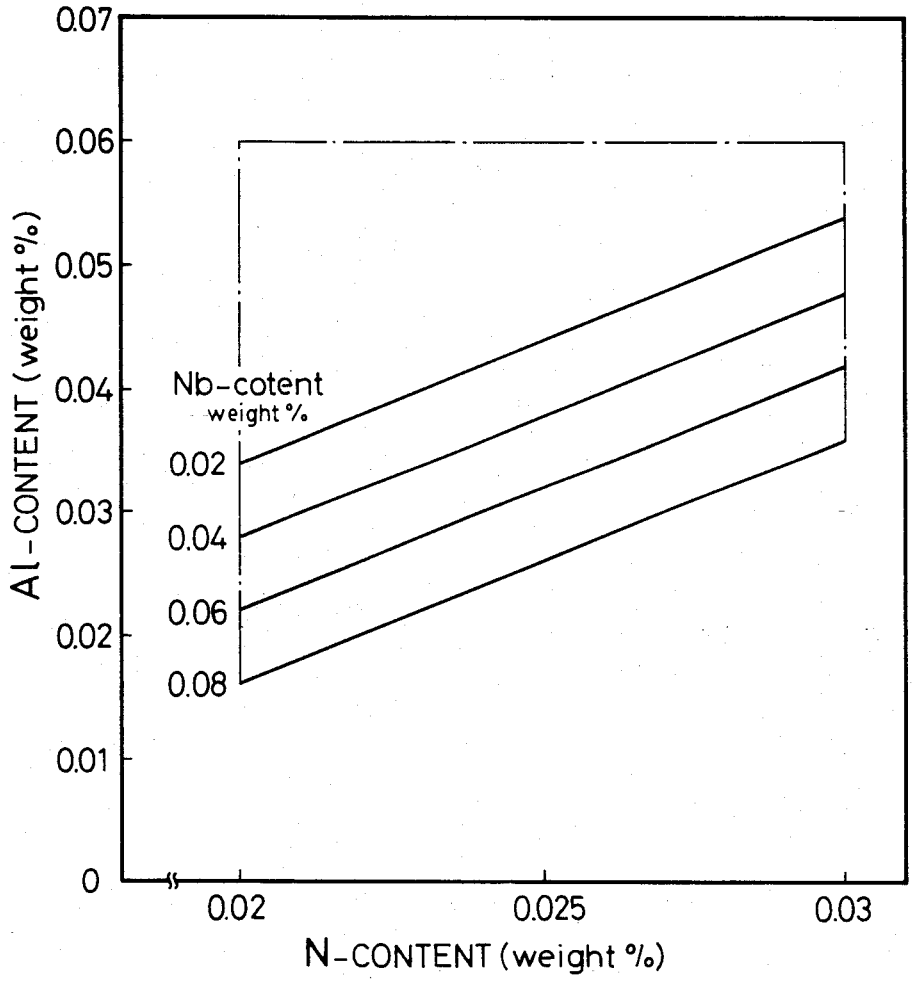
FIG. 1 is a graph showing suitable ranges of Al-content and N-content at various Nb-contents.

As noted above, addition of Al in the amount correlated to the amounts of N and Nb prevents decrease of resilience due to a high N-content. Based on our experiments, the above formula: $Al(\%) \geqq 2.0[N(\%) - 0.15Nb(\%)]$ was concluded. This is illustrated in FIG. 1.

Figure 2:
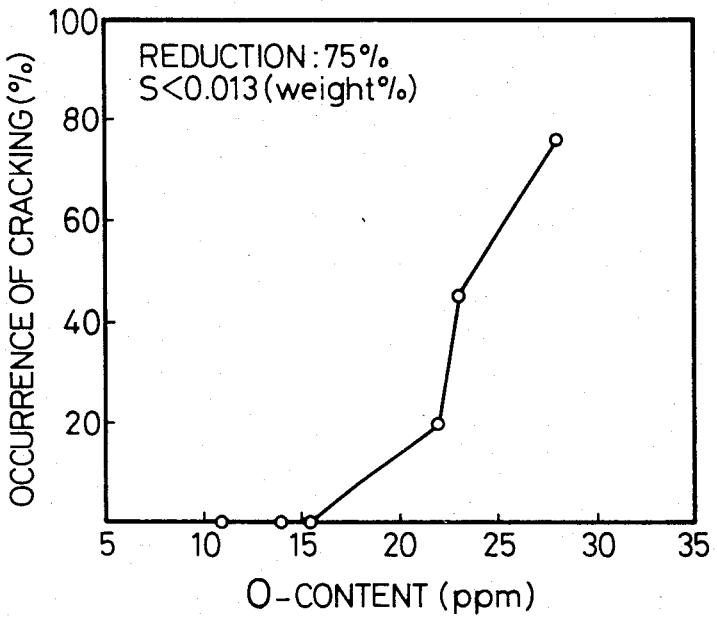
FIG. 2 is a graph showing influence of O-content on the cracking at the cold processing.

O-content above 15 ppm often causes the cracking at the cold processing, and thus the content should not exceed 15 ppm. FIG. 2 shows the influence of O-content on the cracking at the cold processing. The steel used for these experiments contains S of less than 0.013%. The test pieces were cold forged under reduction of 25%, and subjected to inspection of the cracking. As seen in the Figure, occurence of the cracking remarkably increases at an O-content above 15 ppm.

Figure 3:
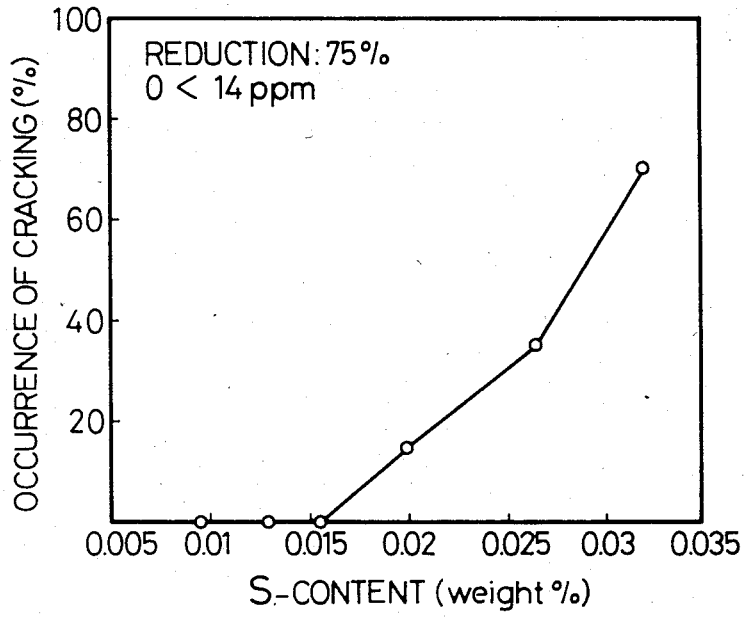
FIG. 3 is a graph showing influence of S-content on the cracking at the cold processing.

Also, a S-content high than 0.015% makes the possibility of cracking at the cold processing higher, and the upper limit of S-content is thus determined. FIG. 3 shows the influence of S-content on the cracking during the cold processing. In the steel tested, O-content is less than 14 ppm. The cold processing was carried out also under reduction of 75%. As the Figure shows, occurrence of the cracking significantly increases at an S-content exceeding 0.015%.

The above controlling of the alloying elements and impurities provides a case hardening steel for cold forging of good properties, which steel may not crack at the cold processing under reduction of 15% or more, and in which coarse crystals of grain size number 5 or less after being heated to a temperature above $A_3$ transition point do not appear in the steel to maintain the original resilience.

The case hardening steel of the present invention may further contain, if desired, a machinability improving elements such as Ca, Pb and Te, Cu for improving weather resistance, and Ti, V, Zr or Ta for further improvement of grain size.

The steel for cold forging according to the present invention is characterized by the structure of ferrite+pearlite and by the ferrite grain size number 9 or higher.

The structure, ferrite+pearlite is chosen because, when a rolled steel product is cold forged as it is, bainite structure is so hard that mold life will be short. The ferrite grain size number 9 or higher is necessary for avoiding the cracking at the cold processing. The ferrite grain size number is determined by "the method of determining ferrite grain size in steel" defined in JIS G 0552.

The method of making the steel having the above described structure comprises preparing a molten steel containing at least one selected from the group of Al, Ti, Nb, V, Zr, Ta and Hf in an amount of 0.005 atomic % or more, C and N in a total amount of 0.005 atomic % or more, and any permissible alloying elements, and O-content being not exceeding 20 ppm and S-content being not exceeding 0.025 weight %; casting the molten steel by continuous casting or ingot casting to form a cast piece or an ingot; heating the cast piece or the ingot to a temperature of 1150° to 1350° C. and rolling it to form a slab; and soaking the slab at a temperature of 850° to 1150° C. and further rolling the slab.

The above noted elements, Al, Ti, Nb, V, Zr, Ta and Hf combine with C and N to form carbides or nitrides (hereinafter represented by "carbonitrides"): AlN, TiC, TiN, Nb(C,N), V(C,N), ZrC, ZrN, Ta(C,N), HfC and HfN. These compounds provide seeds or sites of austenite crystal formation when the steel is heated to a temperature above the $A_3$ transition point, and also suppress growth of the austenite crystals so that the fine ferrite crystals are finally maintained in the steel. This effect by the carbonitrides cannot be obtained if the total amount of Al, Ti, Nb, V, Zr, Ta and Hf is less than 0.005 atomic %. Also, the amount of 0.005 atomic % is the least content which effectively prevent coarsening of the austenite crystals during the heat treatment after the cold forging. The content of these elements should not exceed 1 atomic %.

C and N should be added in an amount of 0.005 atomic % or more as to form suficient amount of the carbonitrides of Al, Ti, Nb, V, Zr, Ta and Hf. However, as a steel for cold forging, too high C-content heightens hardness of the material and is not favorable in view of short life of forging mold. The upper limit of 0.5 weight % is thus chosen. Also, too high N-content causes occurrence of blow holes to damage the cast steel. The N-content should be up to 0.03 weight %.

In order to diminish the oxide inclusions and sulfide inclusions which may provide starting point of the cracking at the cold forging to the extant of no trouble, O-content and S-contents must be decreased to 20 ppm or less and 0.025 weight %, respectively.

A cast piece or an ingot of thus prepared steel is then heated to a temperature of 1150° to 1350° C., and then rolled to a slab. This temperature range is chosen for the purpose of once resolving relatively large particles of the carbonitrides of Al to Hf which precipitated during solidification and cooling of the cast steel so as to obtain finely precipitated carbonitrides of the above elements, Al to Hf, which are useful to keep the austenite crystals fine during the second rolling step. At a heating temperature lower than 1150° C., resolution of the large particles of the carbonitrides is insufficient. On the other hand, at a heating temperature higher than 1350° C., the austenite crystal grows too large to obtain the preferable fine ferrite crystals.

The secondary rolling of thus prepared slab is carried out after being kept at a temperature of 850° to 1150° C. Heating the slab in which the carbonitrides of Al to Hf are fully resolved to a temperature of 850° to 1150° C., causes precipitation of fine carbonitrides, which are effective for forming fine austenite crystals. Soaking at a temperature higher than 1150° C. results in coarsening of the austenite crystals, and it cannot be expected to obtain the fine ferrite crystals of the grain size number 9 or higher in the rolled product. Rolling at a temperature lower than 850° C. is difficult because resistance to transformation of the rolled material is too high.

The present method of making case hardening steel by continuous casting comprises continuously casting a molten steel comprising C: 0.10 to 0.35%, N: 0.015 to 0.030%, Nb: 0.005 to 0.050% and soluble Al: 0.015 to 0.060%, and the balance being Fe and impurities, and characterized by choosing the alloy composition and the cooling rate so that the following relation is satisfied by N-content, Nb-content and average cooling rate Rc at the center of the cast piece during the period from pouring the molten steel in the mold to completion of solidification:

$$N(\%) \geqq -0.71Nb(\%) + 0.0198\overline{R}c(°C./min)$$

provided that $\overline{R}c$ is not less than 0.9.

In the above alloy composition, C-content, 0.10 to 0.35% is an usul content in a conventional steel to be used with carburizing treatment, and therefore, a kind of given condition.

Consequently, precipitation behavior of Nb(C,N) is to be controlled by the contents of Nb and N. The above ranges are chosen from this point of view. The lower limit, N: 0.015%, is concluded as a compromise of avoiding precipitation of relatively large crystal of Nb(C,N) compounds and providing precipitation of the Nb(C,N) compounds which gives minimum effect of preventing coarsening the austenite crystal at a high temperature. The upper limit, N: 0.030%, is determined from the view to avoid formation of blow holes.

The range of Nb-content, 0.005 to 0.030%, is determined because of the same reason as described above. A small amount of Nb less than the lower limit, 0.005%, will not give precipitation of fine Nb(C,N) compounds which may prevent coarsening of the austenite crystals, while an excess amount higher than the upper limit, 0.030%, inevitably results in precipitation of unfavorable large particles of the Nb(C,N) compounds.

Cooling of the center of the cast piece should be carried out as quick as possible. We have established that the average cooling rate from pouring the molten steel in the mold to completion of solidification at the center must be at least 0.90° C./min.

Figure 6:
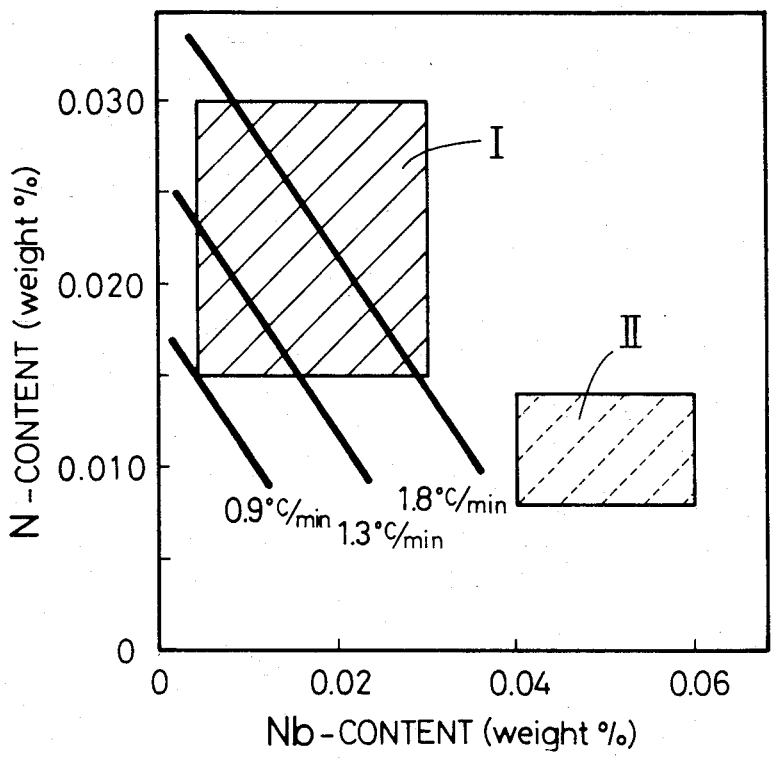
FIG. 6 is a graph showing average rate of cooling the molten steel employed in the present invention and the ranges of N-content and Nb-content correlated thereto, with the ranges of N-content and Nb-content usually used in conventional case hardening steel.

These relations can be understood with reference to FIG. 6. The combination of the Nb-content and N-content used in the present invention is indicated as the domain "I", in which N-content is higher and Nb-content is lower than those of conventionally used domain "II". The operation conditions of the present invention are satisfied only in the domain I and on or the left side of the lines corresponding to various cooling rates (in the Figure, cases of the cooling rates of 0.9°, 1.3° and 1.8° C./min are shown). As readily understood, higher the cooling rate is, wider the ranges of useful Nb-N contents are.

In the present case hardening steel, Al combines with N to precipitate AlN, which, together with the fine Nb(C,N) particles, suppresses growth of the austenite crystals, and Al should be contained as soluble Al in an amount of 0.015% or more. Addition of Al exceeding the upper limit 0.06% damages the cleanliness and decrease the resilience.

EXAMPLES

The present invention will now be further illustrated with the working examples.

EXAMPLE 1

Steels A to H and 1–4 according to the present invention and steels I to T for comparison were prepared and tested. Chemical composition of the steels are as shown in Table I, and results of the tests are as shown in Table II.

Occurrence of coarse crystals of the grain size number 5 or less was determined using cold processing test pieces of diameter 25 mm and length 30 mm under the reduction of 75%, heating at 925° C. for 10 hours followed by water quenching, and macroetching.

Impact strength was measured by preparing JIS No. 3 impact test pieces, which were heat treated at 925° C. for 30 minutes and 880° C. for 30 minutes, and oil quenched, and then tempered by heating at 180° C. for 2 hours followed by air cooling for Shalpy impact test.

Occurrence of cracking was determined by eye inspection of test pieces of diameter 25 mm and length 30 mm which were cold forged under the reduction of 75%.

In the present steel, there was observed no trouble of coarse crystals, decreased impact strength and cracking.

TABLE I

| No. | Chemical Composition* | | | | | | | | | |
|---|---|---|---|---|---|---|---|---|---|---|
| | C | Si | Mn | Cr | Mo | Al | N | Nb | S | O |
| Present Invention | | | | | | | | | | |
| A | 0.19 | 0.20 | 0.70 | 1.10 | 0.16 | 0.050 | 0.028 | 0.025 | 0.013 | 14 |
| B | 0.17 | 0.22 | 0.69 | 1.10 | 0.17 | 0.038 | 0.023 | 0.030 | 0.012 | 9 |
| C | 0.20 | 0.20 | 0.69 | 1.11 | 0.16 | 0.030 | 0.021 | 0.0475 | 0.010 | 13 |
| D | 0.18 | 0.21 | 0.70 | 1.10 | 0.17 | 0.038 | 0.025 | 0.050 | 0.013 | 12 |
| E | 0.19 | 0.20 | 0.68 | 1.10 | 0.17 | 0.026 | 0.022 | 0.065 | 0.011 | 8 |
| F | 0.20 | 0.20 | 0.70 | 1.11 | 0.17 | 0.032 | 0.026 | 0.075 | 0.012 | 10 |
| G | 0.19 | 0.21 | 0.70 | 1.10 | 0.16 | 0.040 | 0.017 | 0.020 | 0.011 | 12 |
| H | 0.19 | 0.20 | 0.70 | 1.10 | 0.17 | 0.041 | 0.018 | 0.015 | 0.010 | 10 |
| 1 | 0.19 | 0.21 | 0.70 | 0.85 | 0.15 | 0.038 | 0.019 | 0.051 | 0.013 | 10 |
| 2 | 0.17 | 0.20 | 0.08 | 0.90 | 0.36 | 0.029 | 0.021 | 0.031 | 0.011 | 13 |
| 3 | 0.20 | 0.20 | 0.69 | 1.17 | 0.13 | 0.031 | 0.018 | 0.041 | 0.012 | 9 |
| 4 | 0.18 | 0.21 | 0.70 | 1.25 | 0.37 | 0.035 | 0.020 | 0.047 | 0.011 | 12 |
| Controls | | | | | | | | | | |
| I | 0.19 | 0.20 | 0.69 | 1.11 | 0.16 | 0.045 | 0.020 | 0.008 | 0.013 | 13 |
| J | 0.20 | 0.21 | 0.70 | 1.10 | 0.17 | 0.035 | 0.012 | 0.020 | 0.010 | 14 |
| K | 0.20 | 0.20 | 0.70 | 1.10 | 0.16 | 0.036 | 0.013 | 0.035 | 0.012 | 11 |
| L | 0.20 | 0.20 | 0.69 | 1.10 | 0.17 | 0.020 | 0.013 | 0.055 | 0.011 | 13 |
| M | 0.19 | 0.20 | 0.70 | 1.10 | 0.17 | 0.025 | 0.012 | 0.0775 | 0.010 | 13 |
| N | 0.20 | 0.21 | 0.68 | 1.12 | 0.16 | 0.015 | 0.022 | 0.075 | 0.014 | 13 |
| O | 0.20 | 0.21 | 0.70 | 1.10 | 0.16 | 0.010 | 0.024 | 0.050 | 0.012 | 12 |
| P | 0.19 | 0.22 | 0.69 | 1.10 | 0.17 | 0.025 | 0.022 | 0.040 | 0.013 | 12 |
| Q | 0.19 | 0.21 | 0.69 | 1.10 | 0.17 | 0.030 | 0.024 | 0.028 | 0.013 | 11 |
| R | 0.19 | 0.20 | 0.69 | 1.11 | 0.17 | 0.032 | 0.021 | 0.042 | 0.020 | 11 |
| S | 0.20 | 0.20 | 0.71 | 1.11 | 0.16 | 0.035 | 0.023 | 0.046 | 0.013 | 22 |
| T | 0.20 | 0.21 | 0.70 | 1.11 | 0.17 | 0.034 | 0.022 | 0.045 | 0.022 | 20 |

*The balance being Fe, expressed by weight % (only O:ppm)

TABLE II

| No. | Coarse crystal of grain size number 5 or less | Impact strength (kgf/cm$^2$) | Occurrence of cracking (%) |
|---|---|---|---|
| Present Invention | | | |
| A | no | 14 | 0 |
| B | no | 16 | 0 |
| C | no | 13 | 0 |
| D | no | 13 | 0 |
| E | no | 17 | 0 |
| F | no | 15 | 0 |
| G | no | 15 | 0 |
| H | no | 14 | 0 |
| 1 | no | 14 | 0 |
| 2 | no | 15 | 0 |
| 3 | no | 17 | 0 |
| 4 | no | 16 | 0 |
| Controls | | | |
| I | yes | 13 | 0 |
| J | yes | 14 | 0 |
| K | yes | 14 | 0 |
| L | yes | 14 | 0 |
| M | yes | 13 | 0 |
| N | yes | 17 | 0 |
| O | yes | 13 | 0 |
| P | no | 8 | 0 |
| Q | no | 7 | 0 |
| R | no | 12 | 15 |
| S | no | 14 | 20 |
| T | no | 12 | 40 |

EXAMPLE II

Steels of the composition shown in Table III were prepared and cast by continuous casting. The obtained cast pieces were heated to the temperature shown in Table IV, and rolled to slabs, which were reheated to the temperature also shown in the Table and further rolled to a round bar of diameter 38 mm.

The products were then tested to determine the grain size of ferrite crystals in accordance with the method defined by JIS G 0552. The results are shown in Table IV.

Figure 5:
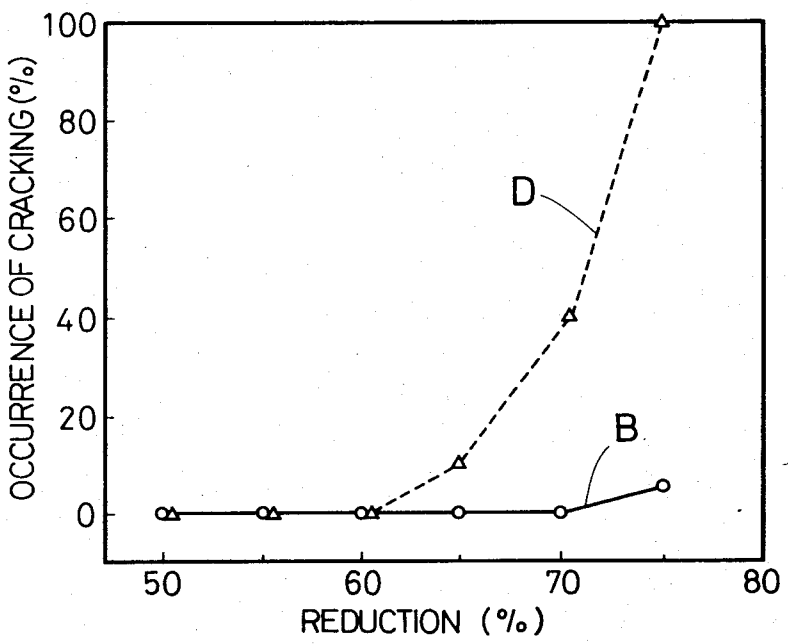
FIG. 5 is a graph showing the relation between the reduction and the crack occurrence in the same example.
Figure 4:
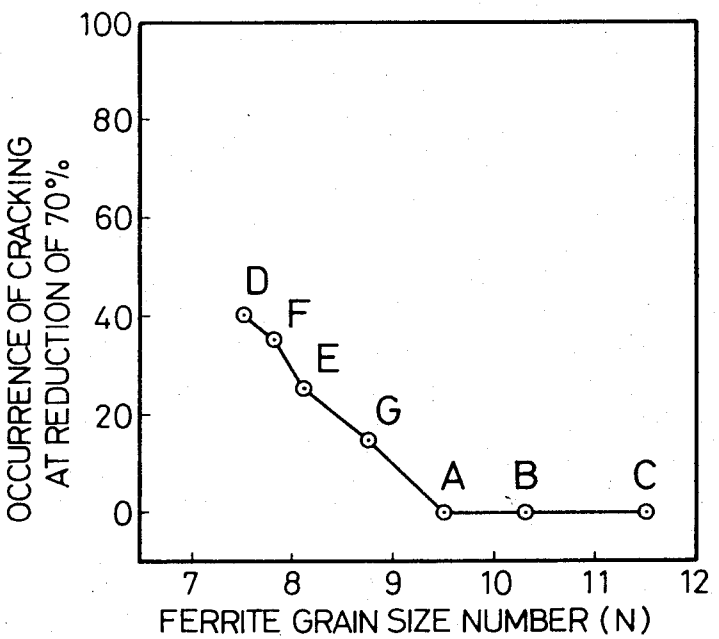
FIG. 4 is a graph showing the relation between the ferrite grain size number and the crack occurrence at 70% reduction in a working example of the invention.

The above products, round bar of diameter 38 mm, were also cold forged under the reductions of 50, 55, 60, 65, 70 and 75% to inspect occurrence of cracking. The results are shown in Table IV and FIGS. 4 and 5. FIG. 4 shows the occurrence of cracking under reduction of 70%, and FIG. 5 shows changes in the occurrence of cracking depending on the changes in the reduction of steels B and D.

As seen from the Table and the Figures, steels A, B, and C, 1 and 2 ferrite grain size numbers of which are above 9 in accordance with the present invention exhibit very low occurrence of cracking, and even under reduction as high as 75% only a few cracking are observed. On the other hand, control steels D, E, F and G, ferrite grain size number of which are less than 9, have high occurrence of cracking, which is considered to be parallel to the ferrite grain size numbers. In steel D, which has the lowest ferrite grain size number, the occurrence of cracking suddenly increases as the reduction of cold forging increases.

Steels D to G were processed under temperature conditions at rolling the cast piece or ingot to a slab and at rolling the slab not in accordance with the present invention, and do not have the ferrite grain size number 9 or high.

TABLE III

| No. | Chemical Composition* | | | | | | | | | | |
|---|---|---|---|---|---|---|---|---|---|---|---|
| | C | Si | Mn | Cr | Mo | Al | N | Nb | Ti | S | O |
| Present Invention | | | | | | | | | | | |
| A | 0.21 (0.98) | 0.23 | 0.69 | 1.10 | 0.17 | 0.042 (0.087) | 0.015 (0.060) | — | — | 0.022 | 0.0017 |
| B | 0.21 | 0.22 | 0.70 | 1.10 | 0.16 | 0.040 | 0.014 | 0.020 | — | 0.023 | 0.0018 |

TABLE III-continued

| No. | Chemical Composition* | | | | | | | | | | |
|---|---|---|---|---|---|---|---|---|---|---|---|
| | C | Si | Mn | Cr | Mo | Al | N | Nb | Ti | S | O |
| | (0.98) | | | | | (0.083) | (0.056) | (0.012) | | | |
| C | 0.20 | 0.24 | 0.70 | 1.11 | 0.16 | 0.037 | 0.015 | 0.010 | 0.010 | 0.022 | 0.0018 |
| | (0.93) | | | | | (0.077) | (0.060) | (0.006) | (0.012) | | |
| 1 | 0.21 | 0.24 | 0.69 | 1.22 | 0.13 | 0.038 | 0.015 | 0.020 | 0.022 | 0.0018 | |
| | (0.98) | | | | | (0.079) | (0.060) | (0.012) | | | |
| 2 | 0.20 | 0.22 | 0.72 | 0.87 | 0.38 | 0.041 | 0.014 | 0.018 | 0.023 | 0.0017 | |
| | (0.93) | | | | | (0.085) | (0.056) | (0.011) | | | |
| Controls | | | | | | | | | | | |
| D | 0.20 | 0.24 | 0.69 | 1.10 | 0.16 | 0.040 | 0.016 | — | — | 0.023 | 0.0018 |
| | (0.93) | | | | | (0.083) | (0.064) | | | | |
| E | 0.20 | 0.23 | 0.70 | 1.11 | 0.17 | 0.038 | 0.014 | 0.018 | — | 0.015 | 0.0015 |
| | (0.93) | | | | | (0.079) | (0.056) | (0.011) | | | |
| F | 0.21 | 0.25 | 0.69 | 1.10 | 0.16 | 0.042 | 0.015 | 0.010 | 0.012 | 0.016 | 0.0016 |
| | (0.98) | | | | | (0.087) | (0.060) | (0.006) | (0.014) | | |
| G | 0.21 | 0.21 | 0.72 | 1.12 | 0.18 | 0.041 | 0.014 | 0.010 | — | 0.019 | 0.0017 |
| | (0.98) | | | | | (0.085) | (0.056) | (0.006) | | | |

*indicated by weight %. (in the parenthese, atomic %)

TABLE IV

| No. | Temperature at rolling cast piece or ingot (°C.) | Temperature at rolling slab (°C.) | Ferrite grain size number | Occurrence of cracking at reduction of 70% (%) |
|---|---|---|---|---|
| Present Invention | | | | |
| A | 1200 | 1050 | 9.5 | 0 |
| B | 1250 | 950 | 10.3 | 0 |
| C | 1300 | 1000 | 11.5 | 0 |
| 1 | 1250 | 1000 | 10.2 | 0 |
| 2 | 1250 | 1000 | 17.5 | 0 |
| Controls | | | | |
| D | 1250 | 1220 | 7.5 | 40 |
| E | 1120 | 1000 | 8.1 | 25 |
| F | 1100 | 1180 | 7.8 | 35 |
| G | 1400 | 1000 | 8.7 | 15 |

EXAMPLE III

Case hardening steels of the composition shown in Table V were prepared and continuously cast at various average cooling rate shown in Table VI. The average cooling rate is defined as the quotient of the difference between the pouring temperature and solidifying temperature with the length of time necessary for the pouring to completion of the solidification. The point at which the molten steel completely solidifies is determined by Hilty's "rivetting method". Using the Nb-content as the requisite and the average cooling rate, the upper limits of permissible N-contents in each cases were calculated in accordance with the above noted formula.

Precipitation of Nb(C,N) of the samples was inspected at the center, surface layer and the midway thereof through an optical microscope.

As the criterion of the effect of the invention, we took austenite grain coarsening temperature. This is determined by heating samples at various temperatures for 30 minutes and water quenching to form austenite crystals, and recording the temperature at which areal percentage of the coarse crystals of austenite grain size numbedr 5 or less exceeds 5%.

The results are shown in Table VI.

References in the Table have the following meaning.

N': permissible upper limit of N-content (%) calculated on the basis of the given Nb-content and the average cooling rate.

Rc: average cooling rate (°C./min.)

Tac: temperature of austenite crystals coarsening.

The data in the Table show that the case hardening steels made in accordance with the present invention have austenite crystal coarsening temperature above 1000° C., and are suitable for being treated by vacuum carburizing.

TABLE V

| No. | Chemical Composition (%) | | | | | | | |
|---|---|---|---|---|---|---|---|---|
| | C | Si | Mn | Cr | Mo | Al | Nb | N |
| Present Invention | | | | | | | | |
| A | 0.21 | 0.23 | 0.69 | 1.10 | 0.16 | 0.042 | 0.006 | 0.025 |
| B | 0.20 | 0.24 | 0.70 | 1.11 | 0.17 | 0.045 | 0.012 | 0.024 |
| C | 0.22 | 0.24 | 0.70 | 1.11 | 0.17 | 0.040 | 0.020 | 0.020 |
| D | 0.20 | 0.23 | 0.71 | 1.10 | 0.16 | 0.039 | 0.028 | 0.015 |
| E | 0.20 | 0.24 | 0.71 | 1.10 | 0.17 | 0.042 | 0.006 | 0.018 |
| F | 0.21 | 0.23 | 0.71 | 1.10 | 0.17 | 0.040 | 0.014 | 0.015 |
| G | 0.22 | 0.23 | 0.70 | 1.12 | 0.17 | 0.041 | 0.006 | 0.015 |
| Controls | | | | | | | | |
| H | 0.22 | 0.21 | 0.70 | 1.12 | 0.16 | 0.040 | 0.015 | 0.027 |
| I | 0.22 | 0.22 | 0.69 | 1.11 | 0.16 | 0.043 | 0.021 | 0.023 |
| J | 0.21 | 0.25 | 0.69 | 1.11 | 0.17 | 0.043 | 0.018 | 0.027 |
| K | 0.20 | 0.24 | 0.71 | 1.10 | 0.17 | 0.041 | 0.007 | 0.013 |
| L | 0.20 | 0.24 | 0.72 | 1.10 | 0.17 | 0.042 | 0.014 | 0.012 |
| M | 0.22 | 0.25 | 0.70 | 1.10 | 0.17 | 0.041 | 0.006 | 0.025 |
| N | 0.21 | 0.22 | 0.70 | 1.11 | 0.16 | 0.039 | 0.016 | 0.017 |
| O | 0.21 | 0.21 | 0.69 | 1.10 | 0.17 | 0.038 | 0.010 | 0.013 |
| P | 0.21 | 0.24 | 0.69 | 1.09 | 0.16 | 0.040 | 0.006 | 0.018 |

TABLE VI

| No. | N' (%) | Rc (°C./min) | Nb(C,N) precipitation | Tac (°C.) |
|---|---|---|---|---|
| Present invention | | | | |
| A | 0.031 | 1.8 | no | 1,040 |
| B | 0.027 | 1.8 | no | 1,070 |
| C | 0.021 | 1.8 | no | 1,080 |
| D | 0.016 | 1.8 | no | 1,060 |
| E | 0.022 | 1.3 | no | 1,050 |
| F | 0.016 | 1.3 | no | 1,050 |
| G | 0.016 | 1.0 | no | 1,030 |
| Controls | | | | |
| H | 0.025 | 1.8 | yes | 950 |
| I | 0.021 | 1.8 | yes | 970 |
| J | 0.023 | 1.8 | yes | 960 |
| K | 0.031 | 1.8 | no | 960 |
| L | 0.026 | 1.8 | no | 970 |
| M | 0.022 | 1.3 | yes | 950 |
| N | 0.014 | 1.3 | yes | 970 |
| O | 0.019 | 1.3 | no | 970 |
| P | 0.014 | 1.0 | yes | 950 |

We claim:

1. A steel suitable for machine structural use consisting essentially of Al: 0.02 to 0.6%, N: 0.015 to 0.03% and Nb: 0.01 to 0.08%, wherein $$Al(\%) \geqq 2.0[N(\%) - 0.15Nb(\%)],$$

the balance being substantially Fe, said steel having an O-content of less than 15 ppm, a S-content of less than 0.015%, and a ferrite+pearlite structure, the ferrite crystal grain size number being 9 or higher, said steel being cold forged and case-hardened.

2. A method of making a steel comprising;

preparing a molten steel consisting essentially of Al, N, and Nb in a total amount of 0.05 atomic weight % or more, C in a total amount of up to 0.5 weight %, N in a total amount of up to 0.03 weight %, the total amount of C and N being 0.005 atomic % or more, the balance being substantially Fe, and having an O-content of up to 20 ppm and a S-content of up to 0.025 weight %;

casting said molten steel to form a cast piece;

heating said cast piece to a temperature within the range of 1150° C. to 1350° C.;

rolling said cast piece to form a billet;

heating said billet to a temperature within the range of 850° C. to 1150° C.; and, rolling said billet;

thereby forming a steel which consists essentially of Al: 0.02 to 0.06%, N: 0.015 to 0.03% and Nb: 0.01 to 0.08%, wherein $$Al(\%) \geqq 2.0[N(\%) - 0.15Nb(\%)],$$

the balance being substantially Fe, said steel having an O-content of less than 15 ppm, a S-content of less than 0.015%, and a ferrite+pearlite structure, the ferrite crystal grain size number being 9 or higher, said steel further being cold forged and case-hardened.

3. A method of making steel according to claim 2 wherein said molten steel is cast by continuous casting.

4. A method of making steel according to claim 2 wherein said molten steel is cast by ingot casting.

5. A method of making steel according to claim 2 wherein said molten steel contains at least one additional component selected from the group consisting of Ti, Zr, Hf, and combinations thereof in an amount of from 0.005 to 1.0 atomic %.

6. A steel suitable for cold forging, according to claim 1, which further consists essentially of Cr: 0.80 to 1.30 weight % and Mo: 0.10 to 0.40 weight %, in addition to the other constituent components.

7. A method of making a steel comprising:

preparing a molten steel consisting essentially of Al, N, Nb in a total amount of 0.05 atomic weight % or more, C in a total amount of up to 0.5 weight %, N in a total amount of up to 0.03 weight %, the total amount of C and N being 0.05 atomic % or more, Cr in the range of 0.80 to 1.30 weight %, Mo in the range of 0.10 to 0.40 weight %, the balance being substantially Fe, and having an O-content of up to 20 ppm and a S-content of up to 0.025 weight %;

casing said molten steel to form a cast piece;

heating said cast piece to a temperature within the range of 1150° C. to 1350° C.;

rolling said cast piece to form a billet;

heating said billet to a temperature within the range of 850° C. to 1150° C.; and rolling said billet;

thereby forming a steel which consists essentially of Al: 0.02 to 0.06%, N: 0.015 to 0.03% and Nb: 0.01 to 0.08%, Cr: 0.80 to 1.30% and Mo: 0.10 to 0.40% wherein $$Al(\%) \geqq 2.0[N(\%) - 0.15Nb(\%)],$$

the balance being substantially Fe, said steel having an O-content of less than 15 ppm, a S-content of less than 0.015%, and a ferrite+pearlite structure, the ferrite crystal grain size number being 9 or higher; said steel further being cold forged and case-hardened.

8. A method of making steel according to claim 7, wherein said molten steel is cast by continuous casting.

9. A method of making steel according to claim 7, wherein said molten steel is cast by ingot casting.

10. A method of making steel according to claim 7, wherein said molten steel contains at least one additional component selected from the group consisting of Ti, Zr, Hf, and combinations thereof in an amount of from 0.005 to 1.0 atomic %.

* * * * *